United States Patent [19]

Nebesar

[11] 4,317,978

[45] Mar. 2, 1982

[54] INDUCTION HEATER ARRANGEMENT FOR FORGING BAR STOCK

[75] Inventor: George C. Nebesar, Parma, Ohio

[73] Assignee: Park-Ohio Industries, Inc., Cleveland, Ohio

[21] Appl. No.: 137,567

[22] Filed: Apr. 7, 1980

[51] Int. Cl.[3] ..... H05B 5/02

[52] U.S. Cl. ..... 219/10.71; 219/10.43; 219/10.69; 219/10.77; 432/126

[58] Field of Search ..... 219/10.41, 10.43, 10.67, 219/10.69, 10.71, 10.75, 10.77; 148/148; 266/113; 432/126

[56] References Cited

U.S. PATENT DOCUMENTS

| | | | |
|---|---|---|---|
| 1,980,875 | 11/1934 | Northrup | 219/10.77 X |
| 1,981,631 | 11/1934 | Northrup | 219/10.77 |
| 2,041,029 | 5/1936 | Stargardter | 219/10.77 X |
| 2,379,463 | 7/1945 | Strickland, Jr. | 432/126 |
| 2,402,852 | 7/1946 | Strickland, Jr. | 219/10.77 |
| 2,405,985 | 8/1946 | Strickland, Jr. | 219/10.67 |
| 2,910,565 | 10/1959 | Osborn, Jr. et al. | 219/10.41 |
| 3,604,882 | 9/1971 | Seyfried | 210/10.69 |
| 3,610,861 | 10/1971 | Storey et al. | 219/10.77 |
| 3,689,726 | 9/1972 | Howell | 219/10.71 |
| 4,075,450 | 2/1978 | Lavins, Jr. | 219/10.71 |
| 4,158,758 | 6/1979 | Kunioka et al. | 219/10.43 |

FOREIGN PATENT DOCUMENTS 2704451 11/1977 Fed. Rep. of Germany ... 219/10.77

*Primary Examiner*—Volodymyr Y. Mayewsky
*Attorney, Agent, or Firm*—Meyer, Tilberry & Body

[57] ABSTRACT

An induction heating system for heating an end length of a forging bar following the cut-off therefrom of a previously heated and forged end length is arranged to bring the end length to be heated to a uniform temperature despite the existence of a residual hot end portion from the previous heat. The heating system has an induction heating coil with a longitudinally extending axial passageway therethrough for receiving the bar length to be heated by insertion into a feed-in end of the coil passageway. A stop member is positioned adjacent the open other end of the passageway to abut the forward end of the inserted bar so as to locate it wholly within the passageway. Electrical circuitry is arranged to connect an AC power supply first to a partial portion of the length of the heating coil extending from the feed-in end thereof so as to heat the as yet unheated portion of the inserted bar end length to a temperature more or less corresponding to that of the residually heated endmost portion of the inserted bar length. Thereupon, the electrical circuitry then connects the full length of the heating coil to the power supply so as to evenly heat the inserted bar length throughout its entire extent to the desired forging temperature.

22 Claims, 3 Drawing Figures

INDUCTION HEATER ARRANGEMENT FOR FORGING BAR STOCK

BACKGROUND OF THE INVENTION

This invention relates in general to an induction heating arrangement for metal bar stock and more particularly to a heating arrangement for, and method of heating, an end length of forging bar stock to a uniform temperature throughout directly following the cut-off therefrom of a previously heated and forged end length.

In the commercial production of forgings from metal bar stock, it is common practice to heat an end length portion of the extended bar stock to the desired forging temperature and then subject it to the required forging operations to form it into the desired forging which is then cut off the end of the bar. Thereupon, the end of the forging bar is again heated to forging temperature throughout a similar end length portion which is then formed into the desired forging and the latter cut off the bar end. This procedure is repeated until all of the usable length of the bar stock has been utilized. This forging practice is known in the art as "heating off the end of the bar". After a completed forging is cut off the bar end, a residual hot end spot remains at the bar end.

Where the heating of the forging bar or workpiece is carried out in a combustion furnace, this residual hot spot at the forging bar end does not create any particular problem in heating the next bar end length portion to uniform forging temperature throughout its full extent since the furnace acts to bring the entire bar end length portion up to the same final temperature despite the existence of the hot end spot at the start of the heating operation. However, the residual hot spot at the bar end does create a problem where the heating of the bar end length portion is carried out in induction heating coil systems since these induce energy into and heat the workpiece as a function of the time the workpiece is being heated in the heating coil. Consequently, if the workpiece, at the time when induction heating thereof first begins, has two adjacent sections at substantially different temperatures, then after induction heating this temperature differential between the two workpiece sections will still exist. Accordingly, if a forging bar with a residual hot end spot is heated throughout an end length portion within an induction heating coil and the cool or as yet unheated section of the bar end length portion is brought up to forging temperature, the hot end spot will then be overheated and may even melt.

One proposal for overcoming this problem as disclosed in U.S. Pat. No. 4,075,450, Lavens, hereby made of record in the present application, has been to initially locate the residually heated end of the workpiece or forging bar entirely outside the full heating zone of the induction heating coil, while the cool or as yet unheated portion of the bar end length portion within the coil heating zone is brought up to substantially the same temperature as the residually heated bar end. Thereupon, the forging bar is retracted within the induction coil heating passageway, as by means of hydraulic cylinder operated pusher rod means, to locate the bar end entirely within the heating zone of the heating coil along with the rest of the bar end length portion to be forged, and the inductive heating of the forging bar then continued until the end length portion to be forged has attained the required forging temperature. This two-stage induction heating operation thus brings the entire bar end length portion to be forged to a uniform forging temperature despite the temperature variations that originally existed in such bar portion before the start of the heating operation. However, because it requires among other things the provision of a hydraulic cylinder operated push rod mechanism and a water cooling system for the push rod, the induction heating system of the aforesaid Lavens patent is of rather complicated and expensive character.

SUMMARY OF THE INVENTION

The present invention contemplates a new and improved induction coil heating arrangement for heating to a uniform forging temperature throughout the end length portion of an elongated workpiece from which a previously heated and mechanically processed end portion has been cut off leaving a residually heated end, which heating arrangement overcomes all of the above referred to problems and others and which is of comparatively simple and inexpensive form.

Briefly stated, in accordance with one aspect of the invention, the induction heating coil arrangement has a two-stage heating cycle in the first stage of which only a portion of the heating coil is energized to heat only the portion of the workpiece end length other than the residually heated end thereof until it reaches a temperature generally corresponding to that of such residually heated end, whereupon the entire heating coil is then energized, in the second stage of the heating cycle, to heat the workpiece end length throughout its full extent to a uniform processing temperature.

In accordance with another aspect of the invention, an induction heating coil having positioning means for locating the workpiece end length portion entirely within the coil is provided with electrical circuit means for first connecting an AC power supply to a partial portion only of the length of the coil extending from the workpiece feed-in end thereof so as to energize only such partial coil portion and thus heat only the unheated portion of the work-piece end length portion other than its residually heated end until it reaches a temperature generally corresponding to that of the heated end, and then connecting the power supply across the full length of the coil to energize the entire coil so as to heat the full extent of the workpiece end length portion within the coil to a uniform processing temperature throughout.

In accordance with a further aspect of the invention, control means are provided for automatically switching the connection of the AC power supply to the induction heating coil to effect full length coil energization either at a preselected time interval following the initiation of the partial coil length energization, or when the portion of the workpiece end length portion being heated by the partial coil length portion attains a temperature generally corresponding to that of the residually heated end of the workpiece.

In accordance with a still further aspect of the invention, the positioning means for locating the workpiece end length portion entirely within the heating coil is located adjacent the end of the workpiece receiving passageway of the coil opposite the workpiece feed-in end thereof, and it may be mounted for reciprocation through the passageway to push the workpiece in an endwise direction backwardly out of the coil passageway on completion of the heating operation.

The principal object of the invention is to provide an induction coil heating arrangement of simple and inexpensive character for heating an elongated workpiece end length portion, having a residually heated end, to a uniform processing temperature throughout while located entirely within the heating coil during the heating operation.

Another object of the invention is to provide an induction coil heating arrangement as referred to above for heating an end length portion of an elongated workpiece having a residually heated end to a uniform elevated temperature throughout solely by operation of the coil to produce a plurality of different effective length heating zones within the workpiece receiving coil passageway.

Still another object of the invention is to provide an induction coil heating arrangement as referred to above and operative to first energize a portion only of the coil length to heat the initially unheated portion of a workpiece end length located in the coil to a temperature generally corresponding to that of its residually heated end and then energize the full length of the coil to heat the entire workpiece end length to a uniform elevated processing temperature throughout.

A further object of the invention is to provide an induction coil heating arrangement as referred to above and operative to automatically energize the full length of the coil at a preselected time interval following initial energization of a partial portion of the coil to heat the initially unheated portion of a workpiece end length located entirely within the coil and having a residually heated end.

A still further object of the invention is to provide an induction coil heating arrangement as referred to above and operative to automatically energize the full length of the coil as soon as the initially unheated portion of a workpiece end length having a residually heated end is first heated, by the energization of a partial portion of the coil length, to a temperature generally corresponding to that of the residually heated end.

Another object of the invention is to provide a novel method of heating to a uniform processing temperature throughout, an elongated workpiece end length portion initially having a residually heated end.

Further objects and advantages of the invention will appear from the following detailed description of a preferred species thereof and from the accompanying drawings.

DESCRIPTION OF THE PREFERRED EMBODIMENT

Figure 1:
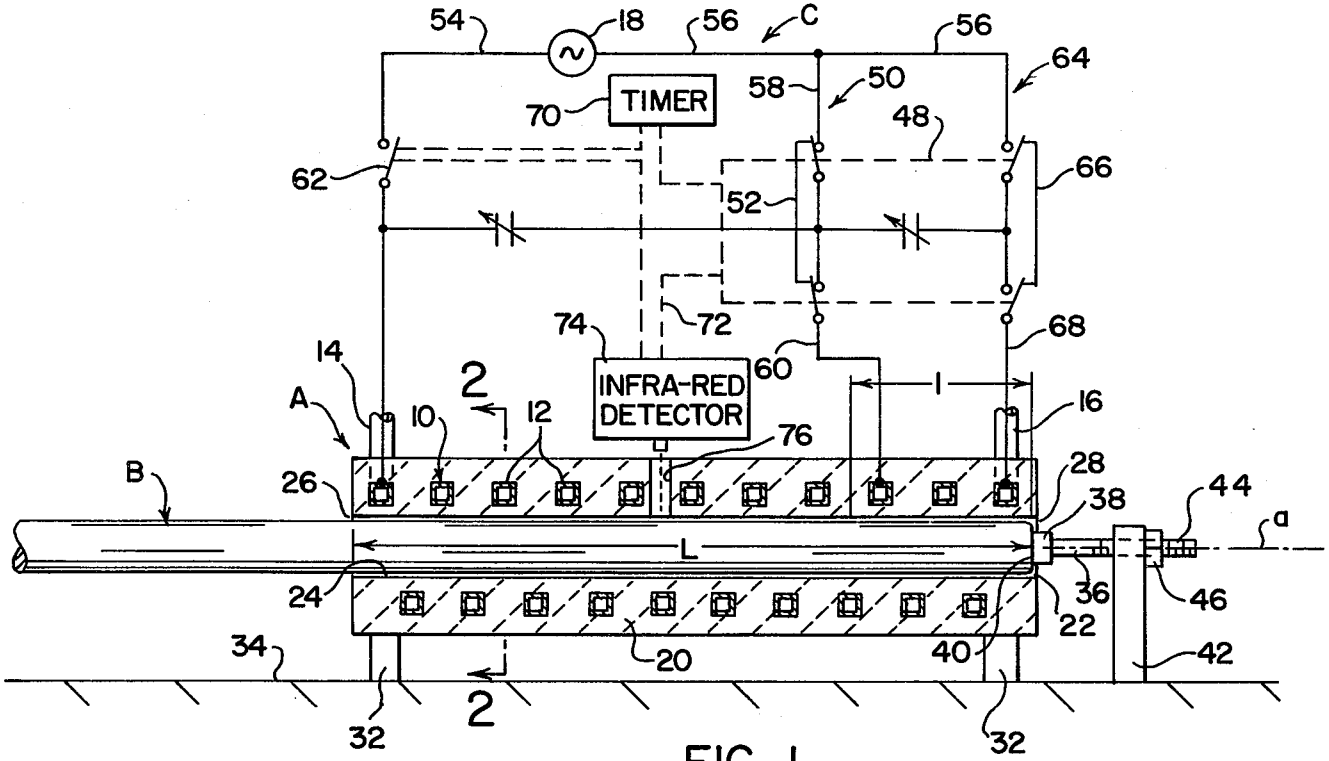
FIG. 1 is a longitudinal sectional view through the induction heating coil of an induction heating system comprising the invention and schematically illustrating the electrical operating circuit and associated control means for energizing the coil.
Figure 2:
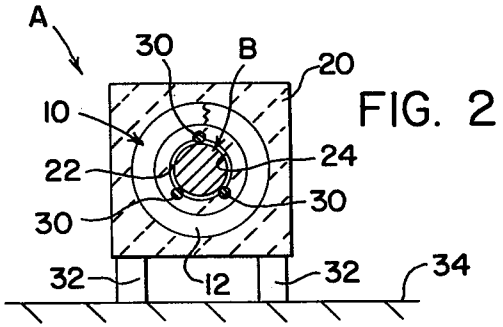
FIG. 2 is a transverse cross-sectional view on the line 2—2 of FIG. 1; and, FIG. 3 is a view similar to FIG. 1 of a modified form of induction coil heating system comprising the invention but omitting the electrical operating circuit for the induction heating coil.

Referring now to the drawings wherein the showings are for the purpose of illustrating a preferred embodiment of the invention only and not for the purpose of limiting same, FIG. 1 illustrates an induction heating system according to the invention and comprising an induction heating coil assembly or inductor A for inductively heating an end length portion L of an elongated workpiece B, such as a metal forging bar, to a uniform elevated processing or forging temperature throughout to permit the processing or forging thereof into an article (not shown) such as a forging which is then cut off the end of the workpiece. A succeeding end length portion L of the workpiece, which may include a portion of the previously heated end length portion from which a forging or other article has been made and cut off, is then similarly heated to the processing or forging temperature in the induction heating coil assembly A and a second forging or other article made therefrom and cut off the end of the workpiece. This heating and processing procedure is repeated until the entire usable length of the workpiece B has been used up.

Induction heating coil assembly or inductor A includes a multiturn induction heating coil 10 formed from a hollow electrical conductor helically coiled in a plurality of convolutions 12 about a linear coil axis a and connected at its opposite ends to a coolant inlet 14 and a coolant outlet 16 which are connected to a supply (not shown) of a suitable coolant and form spaced connector leads for connecting the full length of the coil 10, at certain times during each heating cycle of the apparatus by means of electrical circuit means C, across an appropriate AC power supply schematically illustrated as a generator 18.

The heating coil 10 is embedded in a body of refractory material 20 formed with an elongated central workpiece receiving passageway 22 therethrough coaxial with the central coil axis a and defined by a peripheral wall portion 24 of the refractory body. The wall 24 of passageway 22 is of a contour generally matching the cross-sectional contour of the workpieces B to be processed, which in the particular case illustrated, are metal forging bars or rods of circular cross-section. However, various other contours may be employed for the workpiece receiving passageway 22 in accordance with normal practice. Passageway 22 has an open entrance or workpiece feed-in end 26 and is also open at its opposite end 28, and each workpiece B is intermittently inserted endwise into the passageway 22 through the feed-in end 26 and then withdrawn therefrom through the same end 26 after the end length portion L of the workpiece lying within the passageway 22 has been heated to proper processing or forging temperature in accordance with the invention. After the heated end length portion L of the withdrawn workpiece B has been processed into a forging or other article and the article cut off or separated from the remainder of the workpiece, the end of the workpiece from which the forging or other article has been cut off and which is residually heated is then reinserted into the heating coil passageway 22 through the feed-in end 26 thereof for the start of another heating cycle to heat another end length portion L of the workpiece.

For supporting the workpiece or forging bar B in proper axially centered position within the coil passageway 22 during the induction heating of the workpiece, suitable workpiece support means may be provided within the coil passageway comprising, for example, a plurality of transversely spaced parallel support or slide rails 30 extending longitudinally through the coil passageway 22 of the heating coil unit A parallel to the axis a thereof. As shown, the slide rails 30 are suitably supported in place within the coil passageway 22 as by being embedded in the wall 24 thereof, for example, and they preferably extend outwardly beyond the feed-in end 26 of the heating coil unit A a short distance in order to facilitate the insertion of the workpiece B into the coil passageway 22. The heating coil unit A and its central workpiece receiving passageway 22 are formed of a length at least as great as, and preferably approximately coextensive with, the length of the end length portions L of the workpiece to be heated.

The coil unit or assembly 10 is supported in place, with its coil axis a preferably extending approximately horizontally, on a plurality of support legs 32 fastened to and upstanding from a support base 34 such as a working bench top or platform stand.

In the operation of the induction heating coil system in accordance with the invention, the elongated workpiece or forging bar B is inserted endwise into the heating coil passageway 22 through its open feed-in end 26 and positioned in the passageway with its end length portion L located completely within and coextensive with the full extent of the heating coil 10 and its heating zone. For such purpose, a limiting stop member such as a stop pin or rod 36 having a headed end 38 is provided adjacent and blocking, or opposite, the open end 28 of the passageway against the end face 40 of which the inserted end of the workpiece B abuts, on insertion and passage through the passageway, to thereby properly locate the entire workpiece end length portion L therein. As shown in FIG. 1, the stop member 36 may be a fixed type stop which is adjustably mounted on a support bracket 42 fastened on the support base 34 for adjustment axially of the coil passageway 22 to locate its end face or stop surface 40 at the correct axial location relative to the passageway to position the workpiece end length portion L entirely within the full axial extent of the heating zone of the coil 10. The stop member or pin 36 is provided with a screw threaded shank portion 44 which is threadably engaged with the support bracket 42 to afford axial adjustment of the pin, and a lock nut 46 is threaded onto the shank portion 44 up tight against the support bracket 42 to lock the stop pin in place in the correct axial position. As shown, the headed end 38 of the stop pin 36 is made of small enough size to freely enter into the coil passageway 22 where such is required for correct axial positioning of the end face 40 relative to the heating coil 10, i.e., at the end of the effective heating zone thereof.

In accordance with a principal feature of the invention, electrical circuit means C and associated circuit control means 48 are provided for operating the heating coil 10 in a manner to effect the heating of each successive workpiece end length portion L in a two-stage heating cycle following its insertion into the coil passageway 22 and positioning therein with the end of its residually heated end portion 1 abutted against the stop surface 40. The electrical circuit means C comprises a primary electrical circuit 50 including first switch means 52, circuit leads 54, 56, 58 and 60, and main control switch 62 in lead 54, for first connecting to the power supply 18 to energize, at the start of each heating cycle initiated by closure of main switch 62, only that partial portion of the total length of the heating coil 10, extending from the feed-in end 26 thereof, which is effective to inductively heat the as yet unheated or cool section of the inserted workpiece end length portion L, i.e., the section other than the residually heated end portion l thereof. Thus, only the initially unheated section of the inserted workpiece end length portion L, which ordinarily constitutes a major portion of the total length of the workpiece end length portion L, is heated in the first stage of the heating cycle of the induction heating system comprising the invention. During this first heating step, the residually heated end portion l of the inserted workpiece end length portion L will undergo minimal temperature increase, but the section of the workpiece end length portion L contained within the energized partial and ordinarily major portion of the coil 10 will undergo substantial temperature increase.

The first stage heating of the inserted workpiece end length portion L by the energized partial portion of the heating coil 10 is continued until the temperature of the initially unheated section of the workpiece portion L reaches a temperature corresponding to that of the residually heated end portion l thereof. As soon as this occurs, the control means 48 is then actuated to interrupt the primary circuit 50 so as to de-energize the aforementioned partial portion of the heating coil 10 while at the same time closing a secondary circuit 64 to connect the full length of the coil across the power supply 18, thereby effecting a second stage heating step wherein the entire workpiece end length portion L is uniformly heated throughout to the desired processing or forging temperature which generally may be in the range of from 1700° F. to 2400° F.

The secondary circuit 64 includes second switch means 66 and circuit leads 54, 56 and 68, and it is completed, with main switch 62 closed, by the closure of the second switch means 66 by operation of the control means 48 which may be solenoid operated for example, the switch means 52 at the same time being opened by the control means 48 to interrupt the primary circuit 50. Actuation of the control means 48 to close the second switch means 66 and complete the secondary circuit 64 may be accomplished either manually or preferably automatically is response to either an electrical signal from a timer unit 70 or an electrical signal 72 from an infra-red detector 74 which is supported within a window 76 located in the refractory body 20 between windings of the coil 10 to sense the temperature of the workpiece B, preferably the temperature of the initially unheated section of the inserted workpiece end length portion L. The time interval required to bring the initially unheated section of the workpiece B up to the temperature of the residually heated end portion 1 thereof may be pedetermined on the basis of the material properties of each particular type of workpiece B being processed or on the basis of tests, and set in the timer unit 70. At the end of that time interval, the timer unit 70 will then send a signal to the control means 48 to thereby cause the actuation thereof to close the second switch means 66 and simultaneously open the first switch means 52.

Once the second stage heating of the full length of the inserted workpiece end length portion L has begun, by the energization of the heating coil 10 throughout its full length upon closure of the secondary electrical circuit 64, this second stage heating operation is then continued until the workpiece end length portion L reaches its processing or foregoing temperature throughout, at which time the workpiece is removed from the heating coil passageway 22 by the workman and the heated end length portion L processed into a forging or other article which is then cut off the end of the workpiece or forging bar B. At this time also, the main switch 62 is opened to break both the primary and secondary circuits 50 and 64 and thus stop all further supply of electrical power from the power supply 18 to the coil 10. On de-energization of these circuits 50, 64, the control means 48 then operates to return the switch means 52 and 66 to their initial starting position in readiness for the start of another heating cycle, with the first switch means 52 closed and the second switch means 66 opened. The end of the workpiece or forging bar B from which the processed forging or other article has been cut off, and having a residually heated end portion 1, is then reinserted into the heating coil passageway 22 to position another end length portion L thereof within the coil passageway, and the main switch 62 closed to start the next heating cycle of the apparatus.

The determination as to when the workpiece end length portion L has been heated during the second heating stage to the required processing or forging temperature, and when the main switch 62 should then be opened to terminate the heating cycle of the apparatus, may be accomplished either manually or automatically in response to another signal from the timer unit 70 or from another timer unit 80 (FIG. 3) similar to the timer unit 70, or from the infrared detector 74 or another infra-red detector 82 (FIG. 3) similar to the detector 74 and similarly located to sense the temperature of the heated workpiece end length portion L in the coil passageway 22. The time interval required to bring the workpiece end length section L up to the desired final forging temperature also may be predetermined on the basis of the material properties of each particular type of workpiece B being processed or on the basis of tests, and set in the timer unit 70 or 80. At the end of that time, the timer unit will send a signal to the control means 48 to cause the actuation thereof to reverse the positions of the switch means 52 and 66 and also to the control means (not shown) for the main switch 62 to open the same. Similarly, the infra-red detector 74 or 82, on sensing the temperature of the workpiece end length portion L as having reached the desired processing or forging temperature, will then send a signal similar to and effecting the same results as produced by the signal from the timer unit 70 or 80 as described above.

Figure 3:
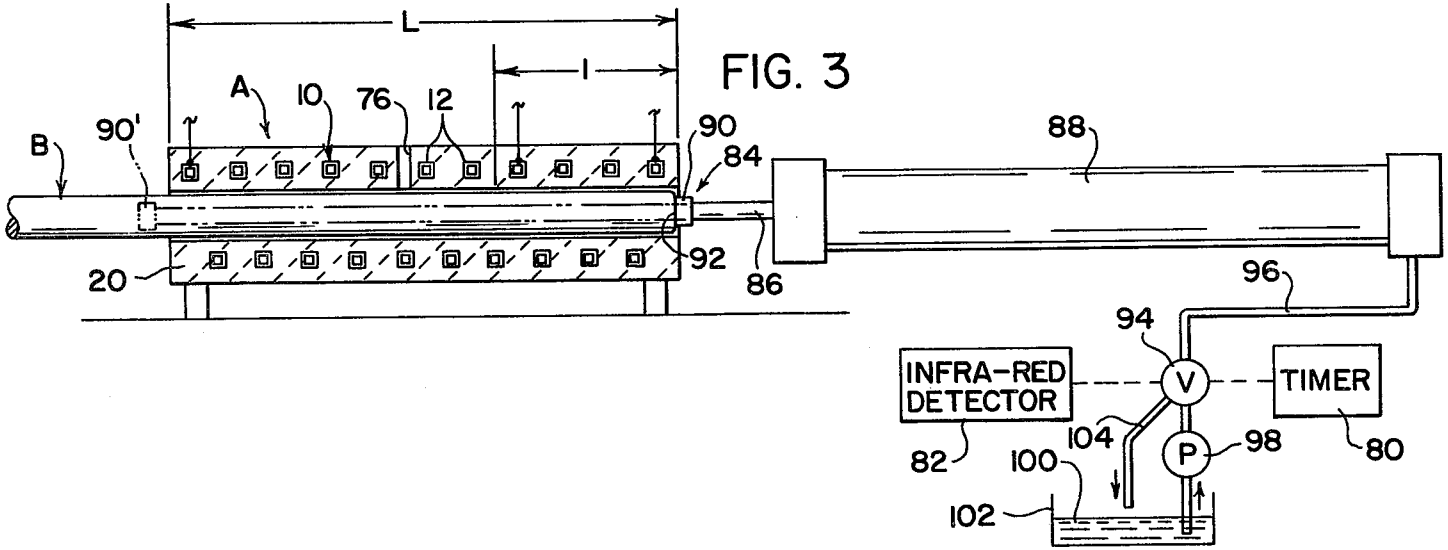

FIG. 3 illustrates a modification of the invention wherein the stop means for abutting the end of the workpiece end length portion L to properly locate it completely within the full effective heating zone of the heating coil 10, in place of being in the form of a fixed stop 36 as in FIG. 1, is in the form instead of a movable stop member 84 mounted for reciprocation within and completely through the coil passageway 22 to push the workpiece B back out of or retract it from the coil passageway 22 on completion of each heating cycle. As shown, the movable stop means 84 may be formed by the piston rod 86 of a hydraulic cylinder 88 which may be supported on the base 34 with its piston rod 86 axially aligned with the coil passageway 22. The piston or push rod 86 is provided with a headed outer end 90 similar to the headed end 38 of the fixed stop pin 36 in FIG. 1 and having a like flat end face 92 for abutting against the end of the workpiece end length portion L inserted into the coil passageway 22 to thereby locate it entirely therein, the same way as in the case of the fixed stop pin 36.

The hydraulic cylinder 88 is actuated to effect the reciprocation of the push rod 86 and cause the headed end 90 thereof to advance through the coil passageway 22 to the dotted position 90' so as to push the workpiece B completely out of the coil passageway as soon as the temperature of the workpiece end length portion L located within the passageway reaches the desired processing or forging temperature, as determined either visually, or automatically by either a timer unit 80 or an infra-red detector 82, as referred to above. The reciprocation of the push rod 86 may be effected in any suitable way as, for example, by having the push rod 86 extensible from the cylinder 88 by pressurized fluid introduced thereinto, and spring biased for retraction into the cylinder 88 from the coil passageway 22. Motion of the push rod 86 of cylinder 88 is controlled by a two way valve 94 communicating with the cylinder through a conduit 96 and connectable either to a pump 98 for supplying the cylinder with hydraulic fluid from a supply 100 thereof in a sump 102, or for emptying the fluid from the cylinder through conduit 96 and valve outlet conduit 104 and into the sump 102 on the spring biased retraction stroke of the push rod.

It should be understood that the induction heating coil 10 and operating circuit arrangement C as described hereinabove is utilized principally for heating the end length portion L of a workpiece B from which a previously heated and mechanically processed end portion has been cut off, leaving a residually heated end. Obviously, however, the induction coil heating arrangement according to the invention could be employed as well to initially heat the end length portion 1 of a new and as yet unheated workpiece B, i.e., one not having a residually heated end, to the desired processing temperature. For such purposes, a suitable circuit arrangement could be provided to initially connect the full length of the heating coil 10 to an AC power supply, such as that shown at 18, to energize the entire coil 10 and thus heat the entire end length portion 1 of the workpiece B initially to the desired processing temperature. Alternatively, such initial heating of the entire end length portion L of a previously unheated or new workpiece B, not having as yet a residually heated end, could be accomplished simply by closing and energizing the secondary circuit 64 of the illustrated circuit arrangement C which, as described above, is operative to energize the full length of the heating coil.

The invention has been described in connection with a preferred embodiment thereof. Obviously, modifications and alterations will occur to others upon a reading and understanding of this specification, and it is my intention to include such modifications and alterations insofar as they come within the scope of the appended claims.

Having thus described the invention, the following is claimed:

1. An induction heating apparatus for heating the end portion of an elongated workpiece to a processing temperature during a heating cycle having an initial portion of a predetermined length, said end portion having a general axial length and a terminal portion residually heated from a prior heating cycle and having an axial length substantially less than said general axial length, said apparatus comprising: an elongated multiturn inductor having a front end, a rear end, and a central workpiece receiving passageway extending between said ends and into which the workpiece is insertable from the said front end of the inductor for stationary axial positioning therein, said inductor including a linear multiturn induction heating coil coaxial with said passageway and having an effective axial heating length between said inductor ends generally matching said general axial length of said workpiece end portion, and means for preventing workpiece heating adjacent an axial segment of said inductor at said rear end during said initial portion of said heating cycle, said inductor segment receiving and corresponding generally to said axial length of said workpiece terminal portion.

2. An induction heating system for heating an end length portion of an elongated workpiece, comprising: an elongated multiturn inductor having a longitudinal axis and an axial passageway therethrough for receiving the workpiece portion to be heated therein, said inductor including a linear multiturn induction heating coil coaxial with said passageway, said passageway having a first open end at one end of said inductor through which the workpiece is inserted into said passageway and a second open end at the other end of said inductor, a stop member mounted adjacent and blocking said passageway adjacent the said second open end thereof to abut the forward end of a workpiece inserted into said passageway through the said first open end thereof and locate said workpiece end length portion in a stationary axial position wholly within said passageway, electrical circuit means comprising primary circuit means including first switch means for connecting a partial portion of the length of said coil extending from adjacent the said one end of said inductor to an AC power supply and secondary circuit means including second switch means for connecting the full length of said coil to the said power supply, and control means actuating said switch means to initially close said first switch means and complete the said primary circuit so as to effect the energization of only said partial coil length portion while at the same time opening said second switch means, and to subsequently open said first switch means to interrupt the said primary circuit means while at the same time closing said second switch means to complete said secondary circuit means so as to effect the energization of the full length of said coil.

3. An induction heating system as specified in claim 2 wherein the said partial portion of the length of said coil comprises a major portion of said coil length.

4. An induction heating system as specified in claim 2 wherein the said control means includes time delay means operatively associated with said switch means to open said first switch means and close said second switch means to effect energization of the full length of said coil at a preselected time interval following the start of workpiece heating by said partial coil length portion.

5. An induction heating system as specified in claim 4 wherein the said time delay means comprises a timer unit.

6. An induction heating system as specified in claim 4 wherein the said time delay means comprises infra-red detector means for sensing the temperature of the portion of the workpiece being heated within the said partial coil length portion of said passageway and actuating said switch means when said workpiece portion attains a pre-selected temperature.

7. An induction heating system as specified in claim 4 wherein said time delay means is also operative to close said first switch means and open said second switch means at a preselected time interval following the said closure of said second heating system means.

8. An induction heating system as specified in claim 7 wherein the said time delay means comprises a timer unit.

9. An induction heating system as specified in claim 7 wherein said time delay means is also operative to interrupt said electrical circuit means at the same time it operates to close said first switch means and open said second switch means.

10. An induction heating system as specified in claim 7 wherein said time delay means comprises: a first timer unit operative to open said first switch means and close said second switch means at a preselected time interval following the start of workpiece heating by said partial coil length portion; and a second timer unit operative to close said first switch means and open said second switch means at a preselected time interval following the said closure of said second switch means.

11. An induction heating system as specified in claim 7 wherein the said time delay means comprises infrared detector means for sensing the temperature of the portion of the workpiece located within the said partial coil length portion of said passageway and operative to open said first switch means and close said second switch means when said workpiece portion attains a preselected temperature.

12. An induction heating system as specified in claim 11 wherein the said infra-red detector means is also operative to close said first switch means and open said second switch means when said workpiece portion attains a preselected processing temperature.

13. An induction heating system as specified in claim 7 wherein said time delay means comprises: a first infrared detector means for sensing the temperature of the portion of the said workpiece being heated within the said partial coil length portion of said passageway and actuating said switch means to open said first switch means and close said second switch means when said workpiece portion attains a preselected temperature; and a second infrared detector means for sensing the temperature of the said workpiece end length portion in said coil passageway and operative to close said first switch means and open said second switch means when said workpiece end length portion attains a preselected processing temperature.

14. An induction heating system as specified in claim 2 wherein the said stop member is fixed and located at the mouth of said second open end of said passageway.

15. An induction heating system as specified in claim 2 wherein the said stop member comprises a pusher member mounted for reciprocation within said passageway to push the said workpiece backwardly through and completely out of said passageway when the said workpiece end length portion heated therein reaches a preselected processing temperature, and actuating means associated with said pusher member to reciprocate it though said passageway.

16. An induction heating system as specified in claim 15 wherein the said actuating means comprises a hydraulic cylinder.

17. An induction heating system as specified in claim 15 wherein the said control means comprises time delay means operatively associated with said switch means to open said first switch means and close said second switch means at a preselected time interval following the start of workpiece heating by said partial coil length portion, said time delay means also being operatively associated with and operating said actuating means at a preselected time interval following the said closure of said second switch means.

18. An induction heating system as specified in claim 17 wherein the said time delay means comprises a timer unit.

19. An induction heating system as specified in claim 17 wherein the said time delay means comprises infrared detector means for sensing the temperature of the portion of the workpiece being heated within the said partial coil length portion of said passageway and operative to open said first switch means and close said second switch means when the said workpiece portion attains a preselected temperature, said infra-red detector means also being operatively associated with and operating said actuator means when the workpiece end length portion in said passageway attains a preselected processing temperature.

20. An induction heating system as specified in claim 17 wherein the said time delay means comprises: a first timer unit operatively associated with said switch means to open said first switch means and close said second switch means at a preselected time interval following the start of workpiece heating by said partial coil length portion; and a second timer unit operatively associated with said switch means to close said first switch means and open said second switch means at a preselected time interval following the said closure of said second switch means, said second timer unit also being operatively associated with and operating said actuating means at a preselected time interval following the said closure of said second switch means.

21. An induction heating system as specified in claim 17 wherein the said time delay means comprises: a first infra-red detector means for sensing the temperature of the heated portion of the workpiece within the said partial coil length portion of said passageway and operative to open said first switch means and close said second switch means when the said workpiece portion attains a preselected temperature, and a second infra-red detector means for sensing the temperature of the said workpiece portion and operative to close said first switch means and open said second switch means when said workpiece end length portion attains a preselected processing temperature, said second infra-red detector means also being operatively associated with and operating said actuating means when the said workpiece end length portion in said passageway attains said preselected processing temperature.

22. The method of heating, in an axial passageway of an elongated multiturn inductor including a linear induction heating coil coaxial with said passageway, an end length portion of an elongated workpiece having a residually heated end, comprising the steps of: stationarily positioning the said end length portion of the workpiece in the said passageway and entirely within the effective heating zone of the coil, electrically energizing only that portion of the length of the coil coextensive with the initially unheated portion of the said workpiece end length portion to thereby inductively heat only the said workpiece portion and raise it to a temperature generally corresponding to the temperature of the said residually heated end of said workpiece end length portion, and then electrically energizing the full length of said coil to inductively heat the full extent of said workpiece end length portion uniformly throughout to an elevated processing temperature.

* * * * *